US005238135A

United States Patent [19]

Landis

[11] Patent Number: 5,238,135

[45] Date of Patent: Aug. 24, 1993

[54] EASY-OPEN TEAR STRIP LID

[75] Inventor: H. Richard Landis, Oak Lawn, Ill.

[73] Assignee: Landis Plastics, Inc., Chicago, Ill.

[21] Appl. No.: 854,560

[22] Filed: Mar. 18, 1992

[51] Int. Cl.[5] ..... B65D 17/40

[52] U.S. Cl. ..... 220/276; 220/306

[58] Field of Search ..... 220/266, 270, 276, 306, 220/308; 215/253, 254, 256

[56] References Cited

U.S. PATENT DOCUMENTS

| | | | |
|---|---|---|---|
| 389,954 | 9/1888 | Cheswright | 215/256 |
| 1,540,303 | 6/1925 | Anderson | 215/256 |
| 2,742,171 | 4/1956 | Meader et al. | 215/293 |
| 3,519,163 | 7/1970 | Bardell | 220/306 |
| 3,773,207 | 11/1973 | Dokoupil et al. | 220/270 |
| 3,812,994 | 5/1974 | Feldman | 215/256 |
| 3,930,593 | 1/1976 | Ragettli | 220/276 |
| 4,055,267 | 10/1977 | Blair | 215/254 |
| 4,457,447 | 7/1984 | Kirkis | 220/306 |
| 4,500,010 | 2/1985 | Schütz | 220/320 |
| 4,570,897 | 2/1986 | Von Holdt | 249/144 |
| 4,682,706 | 7/1987 | DeVore et al. | 220/276 |
| 4,735,337 | 4/1988 | Von Holdt | 220/276 |
| 4,819,825 | 4/1989 | Landis | 220/276 |
| 4,930,656 | 6/1990 | Blanchette | 220/276 |
| 4,966,302 | 10/1990 | Hjordie | 220/306 |

FOREIGN PATENT DOCUMENTS

| | | |
|---|---|---|
| 204942 | 8/1959 | Austria . |
| 3233805A1 | 3/1984 | Fed. Rep. of Germany . |
| 1335722 | 10/1973 | United Kingdom . |

*Primary Examiner*—Stephen P. Garbe
*Assistant Examiner*—Nova Stucker
*Attorney, Agent, or Firm*—Fitch, Even, Tabin & Flannery

[57] ABSTRACT

A reclosable plastic lid having a peripheral flange with a substantially annular projection that engages an annular shoulder on a container sidewall to retain the lid initially on the container full of contents. The flange is formed with a weakened portion defining a tear strip which removes to detach spaced portions of the flange along with portions of the annular projections leaving flange portions which are folded upwardly about hinge lines to retracted positions out of locking engagement with said annular shoulder. With the tear strip removed and the remaining flange portions pivoted outwardly toward horizontal positions, it is much easier to remove the lid from the container. When the lid is re-applied to reclose the container, the remaining attached, flange portions are pivoted down into engagement with container shoulder to retain the lid on the container and thereby, prevent spillage of the container's contents.

13 Claims, 4 Drawing Sheets

EASY-OPEN TEAR STRIP LID

The present invention relates generally to molded plastic lids for use as closures for plastic containers and specifically to a molded plastic lid which is easy to remove from the container and which may be reapplied to reclose the container against spilling and splashing its contents.

BACKGROUND OF THE INVENTION

It has been well known in the closure art to use molded plastic covers or lids having various types of tear strips to permit easy opening or removal of the cover or lid. The tear strip is integrally molded with the lid having a frangible wall portion interconnecting the tear strip to the main portion of the lid. The tear strips may perform the dual functions of (1) providing a positive indication that the contents of the container have not been distributed or tampered with, and (2) securing the lid in sealed engagement with the container.

The present invention is particularly directed to large plastic lids of the kind used to seal five gallon containers, although it may be made smaller and used for smaller containers. These large containers and lids must often meet a drop test in which the container full of liquid is dropped four feet to see if the lid remains sealed after the drop.

Conventional, large size lids are available that readily pass this drop test but they suffer from not being easily removed from the container. These conventional lids typically have about eight depending skirt segments, each of which has an opening or slot to receive a pointed tool such as a screw driver tip that is driven into the skirt segment; and then the screw driver is used as a lever to pry the segments outwardly to pull their internal sealing bead sections outwardly from the mating sealing bead on the container. A pliers also may be used to grip a skirt segment and used to bend and pull the flange segment radially outwardly. For five gallon paint containers, the plastic usually used is high density polyethylene, which is much less flexible than low density polyethylene and has a cross-sectional thickness such that it often requires considerable force and energy to open such a large lid even after pulling the flange sections outwardly because they are still biased to engage the container locking bead.

Such molded plastic paint containers are often as large as 12 inches in diameter, providing a substantial linear distance over which the seal between lid and container must be maintained. Two limiting aspects to the means of sealing such lids to a container are that the lid must be readily removable without special tools and that the lid must be removable in a manner that does not destroy the capacity of the lid to be reused. As explained above, the lid should be removable with the aid of a pair of pliers and a screw driver, and should be in a form that may be re-applied to the container to again reclose the container. Also, such lids must be capable of being molded on high speed injecting molding equipment to be economically competitive with similarly molded plastic lids.

One attempt to make such lids easier to open involves the use of a tear strip which removes parts of the sealing flange on a plastic lid. Such a lid construction is disclosed in the U.S. Patent to Von Holdt U.S. Pat. No. 4,735,337. The plastic lid of the embodiment of FIG. 1 of the Von Holdt Patent has a peripheral flange that is formed with an inwardly extending annular gripping projection that engages the container and includes a tear strip that is formed by an internal V-groove on the inside of the skirt hidden from the user's view. Pulling the tear strip from the skirt removes peripherally spaced portions of the gripping projection to lessen the gripping force provided by the flange. After removing the tear strip and the spaced portions of the gripping projection, the remaining flange portions may be deflected outwardly to permit easier removal of the lid. This removal requires the simultaneous outward deflection of these remaining flange portions, while at the same time lifting up on the lid. The outward deflection must be sufficient to disengage the gripping projection from the annular bead or shoulder provided on the outer periphery of the upper edge of the container wall.

Upon reuse of the above described lid of the '337 patent, the lid is forced back on to the container with sufficient force to deflect the remaining flange portions outwardly whereby the gripping projections may re-engage with the underside of the shoulder or bead on the container.

The '337 patent discloses a second embodiment in FIGS. 5 to 7 which utilizes no tear strip and no removable portion on the lid flange 5, but instead has frangible connections between the peripherally spaced flange portions. Once the frangible connections have been severed between the flange portions, a number of peripherally spaced flange portions may be folded upwardly where they tend to remain with their gripping projections disengaged from the container. The lid may then be removed by deflecting the remaining flange portions outwardly in the same manner as with the embodiment of FIGS. 1–4 Thus, the flange portions must be flexed outwardly at the same time the lid is urged upwardly.

In reclosing a container using the lid of the FIGS. 5–7 embodiment of the '337 patent, the same problem as discussed in connection with the FIGS. 1–4 embodiment is encountered. A sufficient force must be applied to the lid to deflect the flange portions from their downwardly disposed position to the outwardly deflected position so that the gripping projections may pass over the annular bead on the container and re-engage with the underside of the bead. After these flange portions have been re-engaged, the intermediate flange portions that were folded outwardly may then be folded downwardly to their re-engaged positions.

SUMMARY OF THE INVENTION

The present invention involves a molded plastic lid which is commercially acceptable in that it can be molded inexpensively and survive a drop test and yet is an easily removable cover that can be used to reclose a container such as a plastic paint container. The lid includes a downwardly extending peripheral flange having an inwardly directed projection or means that engages beneath a shoulder on the container wall to retain the lid in sealed engagement with the container. The peripheral flange is formed with a tear strip allowing a portion of the flange to be removed with the tear strip when the lid is to be removed. The tear strip is defined by an external V-groove visible on the outside of the skirt or peripheral flange that shows the user that the tear strip is removable. The portion of the flange removed with the tear strip includes peripherally spaced portions or segments of the flange which include portions of the projection means. The portions of the flange which remain attached to the lid after the removal of the tear strip are peripherally spaced from each other and are adapted to be folded outwardly to completely disengage from the container shoulder the segments of the annular projection on the portions of the flange remaining attached to the lid.

With half of the flange segments removed, and the other half of the flange segments pivoted, i.e., flipped upwardly, the lid is much easier to remove than the conventional lid and is easier to remove than the lid disclosed in the '337 patent in which none of the remaining flange segments are hinged and are not able to be flipped up to release their grip on the container bead, as in the present invention.

The foldable portions of the lid flange are connected to the remainder of the lid by hinge lines in the form of integrally molded, elongated strips of reduced thickness which extends along an arc. As a consequence of the arc shape and the memory of the plastic, the foldable segments may be positioned in either of two positions, a gripping position extending downwardly and a release position extending outwardly of the lid flange. Upon removal of the lid, the foldable flange segments are positioned in the release position in which they are disengaged from their initial locking engagement with the annular shoulder on the container. After placement of the lid on the container, the flange segments are forced downwardly to grip the container sealing bead. The grip with the container sealing bead acts to hold the container lid on to prevent splashing of the contents from the container while it is being carried from one place to another. Because of an elongation of and stressing of the plastic at the hinge area during the flipping up of the flange segments almost into generally horizontal positions when removing the lid the first time from the container, the flange segments will not return fully to their original gripping position but will be displaced slightly outwardly from their original positions prior to the bending of them upwardly. Nonetheless, the inwardly-projecting, arcuate bead projections on the flange segments will project beneath the sealing bead on the container to maintain a grip to hold the lid onto the container until the flange segments are again pivoted upwardly to a generally horizontal position. The lid may be repeatedly removed and reattached to the container, as desired.

The preferred embodiment is a high density, polyethylene lid for five gallon containers that is formed with relatively stiff flange segments, half of which can be removed by pulling a tear strip with a pliers that separates along a line of weakness, and the other half of which can be pivoted outwardly along hinge lines of reduced cross-sectional thickness. Thick cross barriers between the tear line and hinge lines prevent tearing of the plastic into the hinge lines when removing the tear strip.

Accordingly, it is an object of the present invention to provide an improved plastic lid for a container having a tear strip associated with a sealing flange to remove portions of an annular retaining projection, leaving other spaced peripheral flange segments which are foldable to non-obstructing positions.

It is another object of the present invention to provide an improved resilient molded plastic lid which may be removed by detaching a tear strip and by folding flange segments to non-obstructing positions and which can be reclosed by folding such flange segments downwardly to grip a bead on the container.

BRIEF DESCRIPTION OF THE DRAWINGS

These and other objects and advantages of the invention will become apparent from the following detailed description taken in conjunction with the accompanying drawings in which.

DETAILED DESCRIPTION OF THE PREFERRED EMBODIMENT

Figure 6:
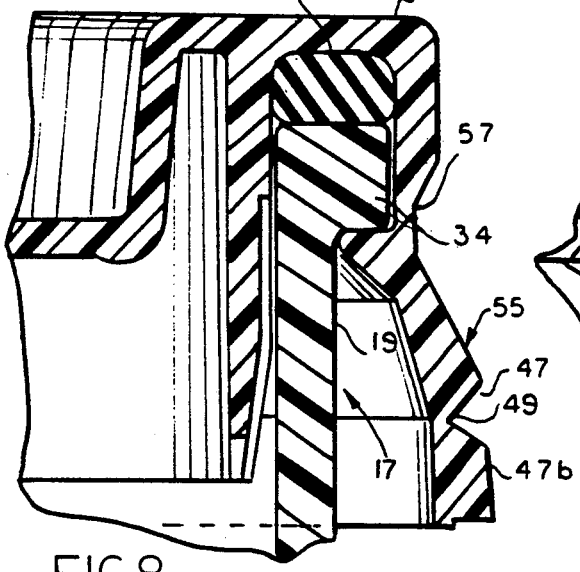
FIG. 6 is an enlarged fragmentary sectional view taken on line 6—6 of FIG. 3 but also showing the sidewall of a container to which the lid is assembled.
Figure 7:
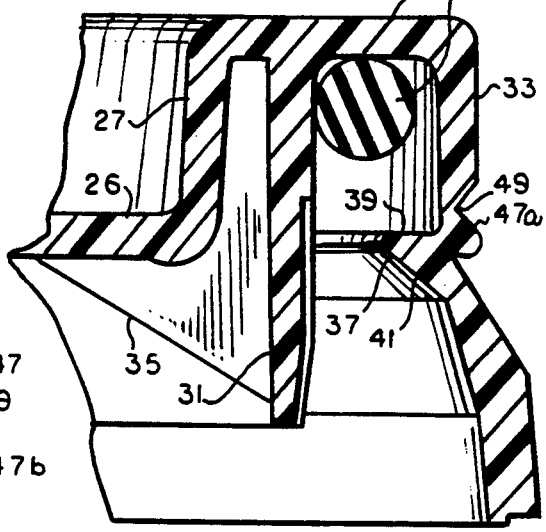
FIG. 7 is an enlarged fragmentary sectional view taken on line 7—7 of FIG. 3.

Referring to the drawings, there is shown a resilient plastic lid embodying the invention and designated generally by reference numeral 15. The lid 15 is intended for use with large plastic containers, e.g., five gallon containers, used for paint or other liquid materials but would have broad application to any containers particularly to containers where the lid is to be used to reclose the container after it has been opened. The lid 15 would be applied to a container 17 having a sidewall 19 which terminates at an upper edge or rim 21 as shown in FIG. 6. Down from the upper edge, the sidewall 19 is formed with a downwardly facing annular shoulder 23.

The lid 15 is formed of a resilient plastic material and includes a circular body portion 25 which has a central disc portion 26 and is formed at its outer edge with upturned flange 27 and a ring 29. The ring 29 is disposed in spaced parallel relation to the circular disc portion 26. Depending from ring 29 of the body portion are two coaxially disposed generally cylindrical flanges or skirts including an inner sealing flange 31 and an outer peripheral flange 33. The flanges 31 and 33 together with the ring 29 form a downwardly facing annular channel 34 which receives the upper edge of sidewall 19 to seal the container 17 against leakage. The inner flange 31 has a close frictional engagement with the inner surface of sidewall 19 and serves to add rigidity and strength to the lid 15. In this connection there are provided a plurality of webs or ribs 35 which extend radially inwardly from the inside surface of the inner flange 31 to the disc portion 26 and the upstanding flange 27. The webs 35 are molded integrally with the lid 15 as are the flanges 31 and 33.

Figure 4:
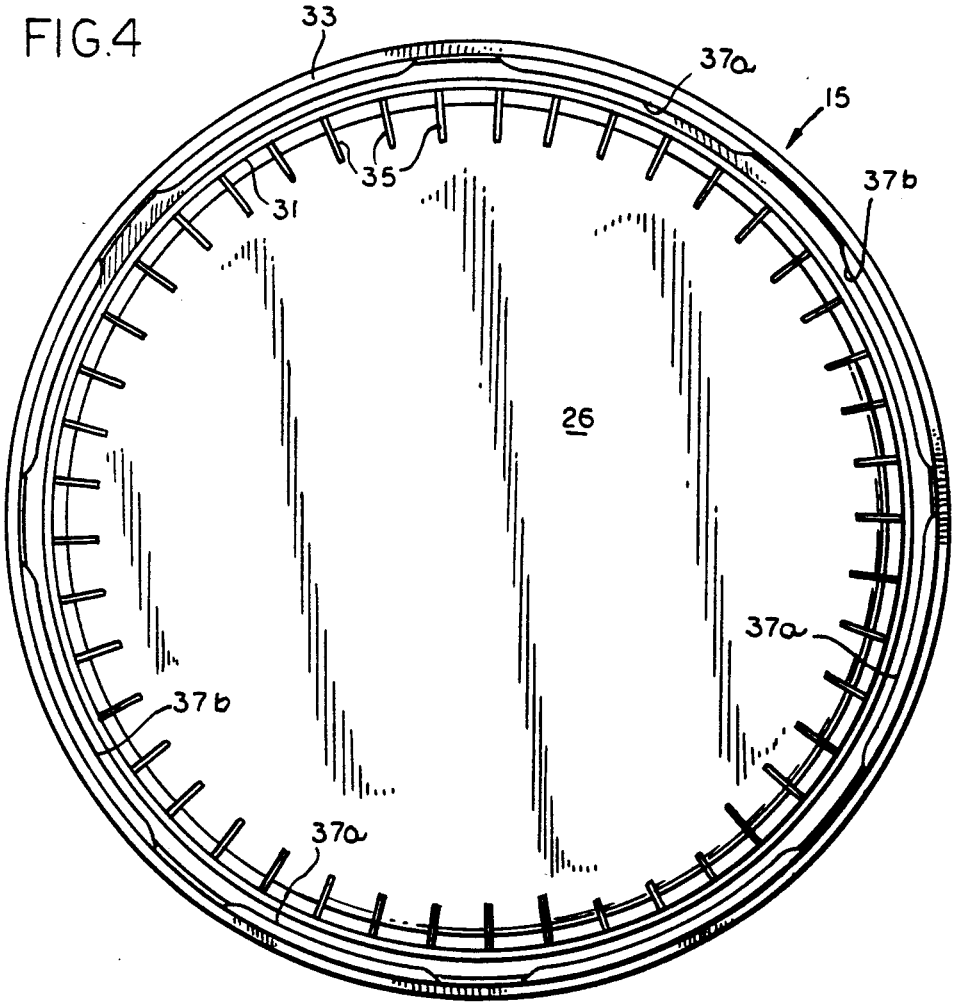
FIG. 4 is a bottom plan view of the plastic lid of FIG. 1.
Figure 5:
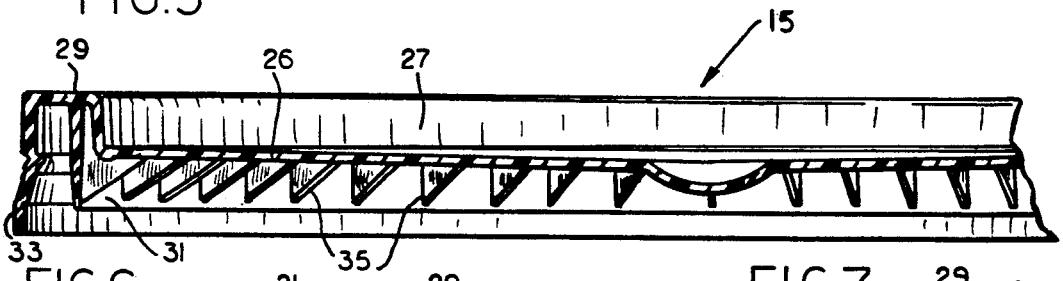
FIG. 5 is a fragmentary central sectional view of the lid of FIG. 1 taken on line 5—5 of FIG. 2.

One of the purposes of the peripheral flange 33 is to engage the upper edge of the sidewall 19 and particularly the annular shoulder 23 to lock the lid 15 downwardly against the container sidewall. The container has an outwardly projecting annular bead 34, (FIGS. 6 and 7) which defines the rim 21 of the container. The bead 34 could be spaced from the rim 21. Protruding radially inwardly from the inside diameter of the lid's outer flange 33 is an annular projection 37 to interlock with the container bead 34. Although the projection 37 may be continuous, in the disclosed embodiment, the projection 37 is made up of a plurality of spaced segments 37*a* and 37*b* as shown in FIG. 4. The annular projection 37 is wedge shaped in cross section as shown in FIGS. 6–9, having a horizontal shoulder portion 39 and an inwardly angled wall 41 extending from the tip of the projection back to the inside wall of the flange 33. The horizontal shoulder portions 39 on the projection segments 37*a* and 37*b* are disposed beneath and abut the underside of the horizontal shoulder 23 of the container bead 34. Herein, a gasket 38 (FIG. 7) which is originally generally round in shape is flattened when the lid is applied and the shoulders 24 and 39 are engaged as shown in FIG. 6. Manifestly, lids may have or not have a gasket and fall within the purview of the invention. The wide base of the projection 37 on the flange 33 renders it relatively stiff and not subject to any significant deflection as it retains the lid 15 in engagement with the container edge 21. The distance between the shoulder portion 39 on the annular projection to the underside of ring 29 is designed to receive the gasket and to have it flattened to provide a tight seal. The lid could be made to seal without a gasket.

In the assembly of the lid 15 to the container 17, the angled wall 41 causes an expansion of the flange 33 along with the annular projection 37 whereby the upper edge 21 of the container 17 may move toward the top of the channel 34 to compress the gasket 38. As captured by the annular projection 37 within the channel 34, the upper portion of the sidewall 19 is gripped between the inner and outer flanges 31 and 33 and between the projection 37 and the ring 29.

In the design of a commercially acceptable lid for a container 17 used for paint or the like, it is important that the lid be easily removable by simple tools such as a screw driver or knife and pliers. It is also important that the lid be removable in such a manner that it may be reusable to reclose the container if the contents are not completely used immediately after the initial opening of the container.

Figure 10:
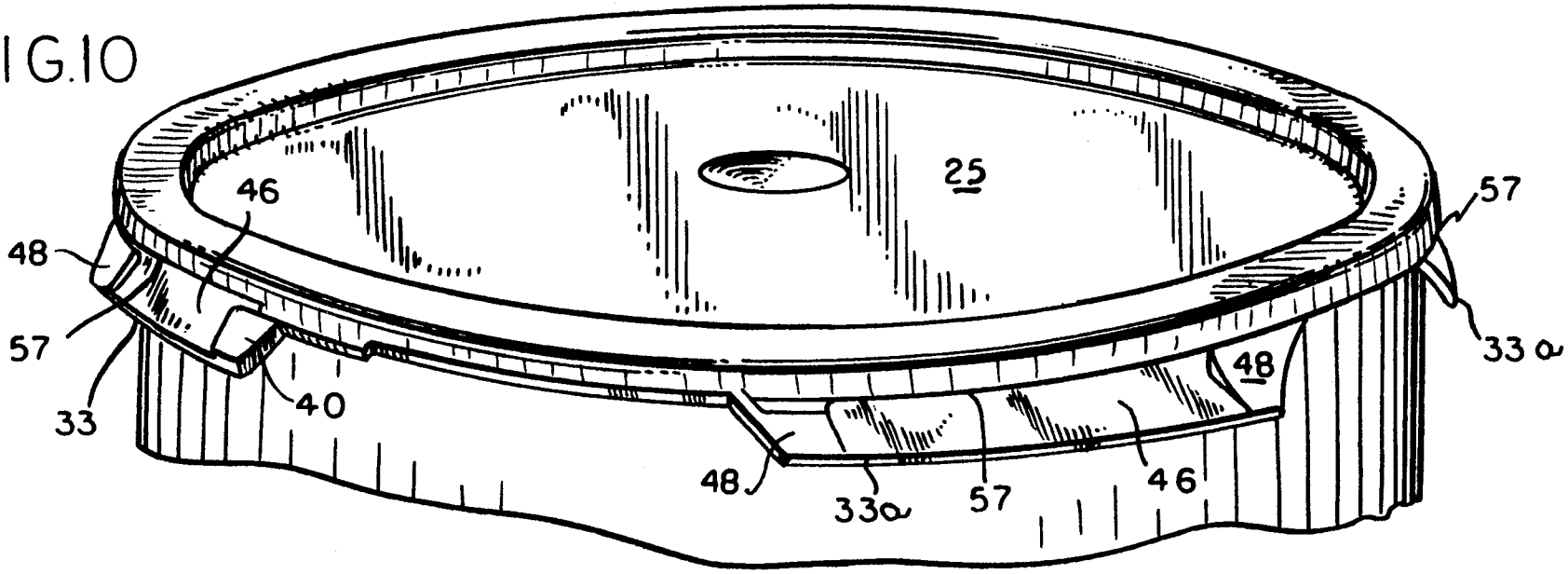
FIG. 10 is a perspective view of the lid of FIG. 1 with one-half of the flange segments removed and the remaining half of the flange segments flipped up for easy removal of the lid from the container.

In order to permit easy removal of the lid 15, a tear strip 43 is provided, which is formed integrally with the peripheral flange 33; and the tear strip 43 permits removal of flange segments 33*a* of the flange 33 which carry portions 37*a* of the annular projection 37 and allow the remaining flange segments 32*b* to be flipped outwardly, as shown in FIG. 10, to non-obstructing positions with respect to the annular bead 34 on the container sidewall 19. The tear strip 43 extends around the entire circumference of the lid 15, having a pull-tab 45 at one end and being disposed at the lower edge of the flange 33. The upper edge of the tear strip 43 is delineated by a V-shaped groove 47, which is facing outwardly on the flange 33, and which provides a weakened section or tear line 49 along which the tear strip separates from the remainder of the flange 33. As shown generally in FIG. 3, the groove 47 follows a somewhat zig-zag path having peripherally extending upper portions 47*a*, lower portions 47*b* and interconnecting angled portions 47*c*.

The purpose of the zig-zag configuration of the tear strip is to provide removal of some of the flanges 33, e.g., the flange segments 33*a* and their segments 37*a* of the annular projection 37 while leaving the other flange segments 33*b* having projections 37*b* thereon. The annular projection 37 is not continuous in the disclosed embodiment, being interrupted at intervals where the angled portions 47*c* of the grooves 47 extend between the upper and lower portions 47*a* and 47*b*. This projection means can have various shapes and be either substantially annular, which is defined to include annular or widely-spaced lugs or the like. As shown in FIGS. 4 and 10, the annular projection 37 is divided into segments 37*a* which are detached from the flange 33 along with the tear strip 43 and segments 37*b* which remain with the flange 33 after removal of the tear strip 43. While the length and number of the segments 37*a* and 37*b* may vary, in the disclosed embodiment there are four of the segments 37*a* which are separated by segments 37*b*. Accordingly, when the tear strip 43 is detached from the lid 15, it carries with it the annular projection segments 37*a*, leaving four peripherally-spaced flange portions 33*b* which carry the annular four projection segments 37*b*.

In the lid disclosed in U.S. Pat. No. 4,735,337 in FIGS. 1–4, an annular circumferential tear line formed a zig-zag path about the inside of the lid skirt and was relatively thin, about 0.020 broke when the container was dropped four feet in sufficient number of instances to fail the drop test.

Figure 8:
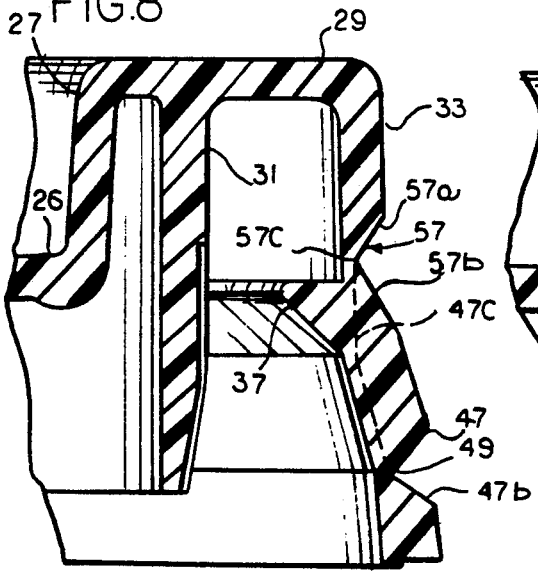
FIG. 8 is an enlarged fragmentary sectional view taken on line 8—8 of FIG. 3.

It is a particular problem to locate the line of weakness and to determine its thickness such that it does not break when the filled container is dropped in the drop test; and yet readily tears to remove one-half of the flange segments 33*a* while leaving the other half of the flange segments 33*b*. Also, in the preferred embodiment of the invention, these remaining flange segments 33*b* are provided with a thin cross-section hinge line or area of weakness 57 about which the flange segments bend outwardly to their release position, as shown in FIG. 10. As best seen in FIG. 8, the hinge line 57 is a V-shaped notch, in the preferred shape therefor, having inclined sides 57*a* and 57*b* meeting at an intersection 57*c*. It is desired to extend the hinge line 57 in each flange segment 37*b* as long as possible in the segment to provide a long hinge line of reduced cross-sectional thickness. This longer line allows for easier pivoting of each flange segment 37*b* which are arcuate segments in shape and do not want to bend about the hinge line because of this arcuate shape. Yet, it is important that the tear strip 43 not tear into these hinge lines which are at about the same height on the flange 33 as the V-shaped grove 47 at the locations above the removable flange segments 33*a*, (see FIG. 1 and contrast FIGS. 7 and 8). When pulling on the tear strip 43 with the pliers, the tear strip wants to continue across the narrow plastic, e.g., 1/16 to ⅛, thick plastic piece between the V-shaped groove 47 and the hinge lines 57. This is prevented in the present invention by a barrier 48 in the form of a full thick, cross portion of the lid of about 0.070 inches, as contrasted to groove 49 which reduces the plastic to about 0.035 inches in this preferred embodiment of the invention. Herein, the hinge groove 57 is about 0.030 inches thick at 57*c*. Thus, the barriers 48 prevent the plastic tearing from the groove 49 into a hinge line 57.

These five gallon lids illustrated in the drawings are typically molded from high density polyethylene having about 0.95 density, a low melt index of 5 to 10, and are made of the same plastic material that conventional five gallon pain lids are usually made. This is a much stiffer material than low density polyethylene of which smaller and peelable lids are sometimes made. The wall thickness of the flange is often about 0.075 inches with the hinge line 57 being about 0.030 inches in this illustrated embodiment of the invention. These dimensions and materials are given by way of example only, and not by was of limitation.

Figure 1:
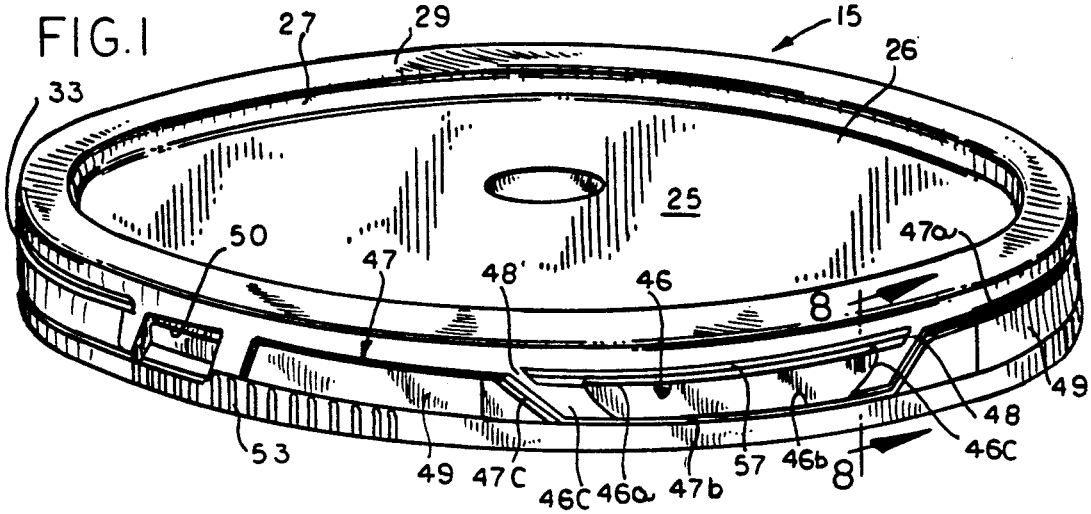
FIG. 1 is a perspective view from above of a resilient plastic lid embodying the invention.
Figure 2:
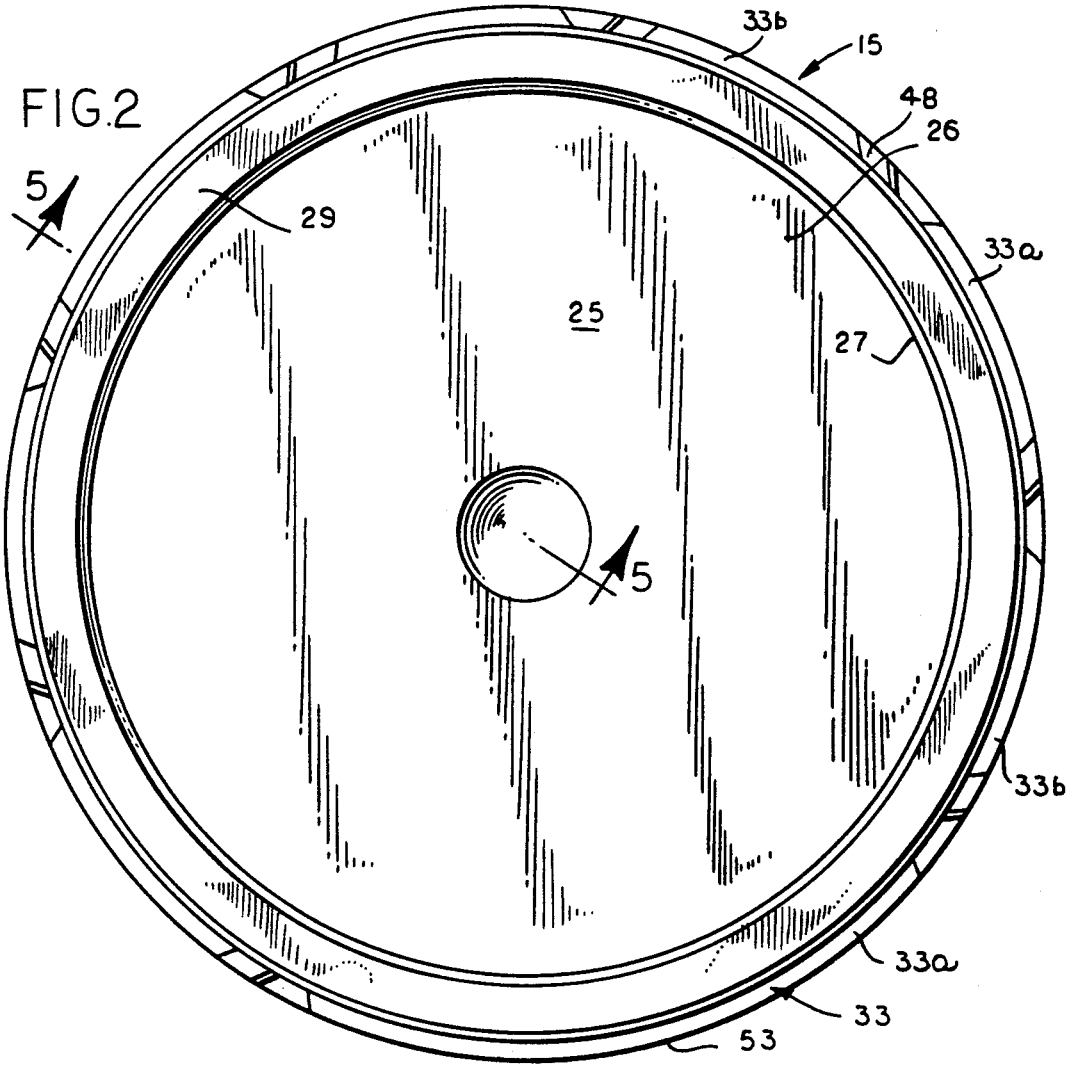
FIG. 2 is a top plan view of the plastic lid of FIG. 1.

As best seen in FIG. 1, it is preferred to reduce the cross-sectional thickness of the flange 33 by having outwardly facing indentations 46 in the segments **37*b* which remain after tear strip removal. The indentations 46 extend between upper and lower edges 46*a* and 46*b*, and vertically extending side edges 46*c* and 46*d*. The side edge 46*c* is spaced from an adjacent inclined portion 47*c* of the groove 47 by the full cross-sectional thickness barrier 48 of the skirt of substantial width to prevent a tearing into the indentation 46 by the tear strip 43, rather a continued tearing along the groove 47. That is, if the full thickness of substantial extent does not separate the indentation 46 from the groove 47, there is a tendency for the tear strip to tear across into the indentation 46, rather than proceeding down along the inclined groove portion 47*c*, to a portion of the groove 47 beneath or above the indentation. A similar indentation 49 is preferably formed in the outer surface of the removable tear strip 43 to reduce the cross-sectional wall thickness of the removable tear strip 43**.

Figure 3:
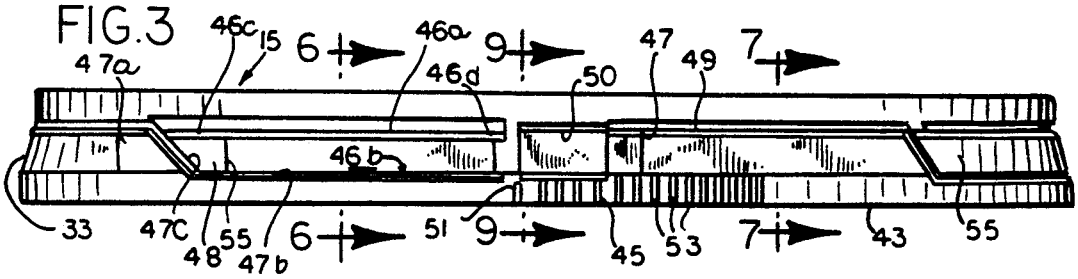
FIG. 3 is a side elevational view of the plastic lid of FIG. 1.
Figure 9:
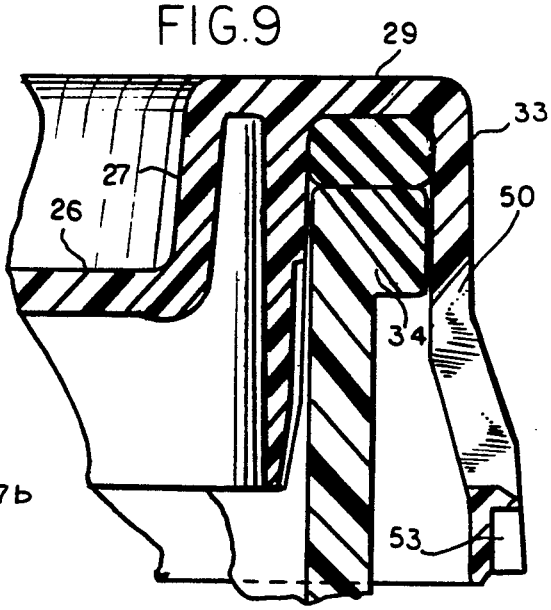
FIG. 9 is an enlarged fragmentary sectional view taken on line 9—9 of FIG. 3.

As best shown in FIGS. 1, 3 and 9, at the end of the tear strip 43 and adjacent to the pull-tab 45, the flange 33 is formed with an outwardly-facing opening 50 which is designed to provide access for a screw driver or similar tool to break loose the pull tab. There is a frangible or weakened web or connection 51 at the bottom of opening 50 so that the end of the pull-tab may be easily separated from the other end of the tear strip 43. The pull-tab may then be grasped with pliers and pulled radially outwardly from the lid 15 until the tear strip 43 is detached completely from the lid 15. The pull-tab is provided with serrations 53 to facilitate gripping the pull-tab with pliers.

After the tear strip 43 has been removed from the lid 15 along with the associated portions **33*a* of the flange 33, the lid 15 is still held in sealed engagement with the container 17 by the remaining flange 33*b* segments of the flange 33 which carry segments 37*b* of the annular projection 37. These segments 33*b* of the flange 33 will be termed lid retaining segments for reasons discussed below. To make the lid easier to remove once the tear strip 43 has been detached, the lid retaining segments 33*b* are pivoted outwardly and upwardly as shown in FIG. 10. As previously explained, the segments 33*b* are connected to the remaining portion of the flange 33 by the hinge or thin wall sections 57 which serve as a hinge between each of the segments 33*b* and the remain cylindrical wall of the flange 33. Each thin wall hinge line 57 lies along a peripherally-extending arc on the flange 33 with each segment 33*b* being pivoted about this arc. This pivotal movement tends to straighten the arc formed by the section 33*b***. This straightening of the arc is resisted by the resilience of the plastic material. This condition tends to bias the segments downwardly so it is difficult to have these segments disposed fully in a truly horizontally position.

Thus, when opening the container 17, the tear strip 43 is completely removed from the lid 15 and, then preferably, each of the remaining lid-retaining segments **33*b* is then pivoted upwardly to the disengaged or non-obstructing position. Once the complete disengagement of the annular projections 37*b* from the annular shoulder 43 has been accomplished, the lid 15 is removed by simply overcoming the frictional force associated with the cylindrical surfaces of the flanges 31 and 33 engaging upper edges of the sidewall 19 of the container 17. Since these frictional forces may be significant, it is preferred that all of the flange segments 33*b* are moved to a non-obstructing position with all of the flange segments 37 spaced outwardly of the container bead 43**.

As indicated above, it is often desired to have the lid 15 retained by gripping the sealing bead 34 of the container 17 to retain the container closed if portions of the contents remain and are to be used in the future. If the lid 15 cannot reclose the container, there will often be serious deterioration in the contents and spilling of the contents if the lid is loose or easily shifted to become loose to spillage. The plastic lids of the prior art have typically been either difficult to remove or to reclose or both. In the lid of the present invention, the removal of portions of the annular locking projection **37*b* and the bending of the flange segments 33*b* provides a lid which is easy to remove initially and easy to positively retain on the container because of the gripping engagement of the projections 37*b* with the container bead 34**.

In reclosing the lid 15 to the container 17, the lid is forced downwardly on the upper edge of the sidewall 19 until the edge 21 engages the ring 29. The reclosable flange segments **33*b* are then pivoted downwardly to the engaging position with the container bead 34. The hinge line 57 about which each flange segment hinge is located closely adjacent the edge of the annular bead 34 on the container sidewall 19**.

The lid 15 of the present invention represents a significant advance in the closure art in solving the problems of easy opening and reclosing of the lid on large plastic containers such as five gallon paint containers. While conventional, resilient plastic lids have presented significant cost advantages over metallic lids, there have been shortcomings in the prior art plastic lids in how they are removed from large diameter containers. The lid of the present invention's use of a tear strip to remove portions of the annular retaining projection and having the remaining portions of the retaining projection flipped open to non-obstructing positions is novel and significantly facilitates the lid removal. Similarly, the return of the foldable flange segments **33*b* and their projections 37*b* into gripping engagement with the container bead 34** provides good retention of the lid on the container rim, thereby preventing splashing and spillage of the container contents during subsequent transportation of the container.

What is claimed is:

1. An easy-opening, resilient plastic lid for use with a container having a sidewall terminating at an upper rim with an adjacent locking bead, the combination comprising:

a circular body portion;

a peripheral skirt extending downwardly from the body portion and terminating at a lower edge;

a substantially annular projection on said skirt extending radially inwardly for engagement with the container bead when said body portion is in sealing engagement with the container rim;

an elongated weakened section on said skirt extending around the periphery of said lid and defining a tear line between a removable tear strip portion of said skirt and lid-retaining portions of said skirt, removal of said tear strip detaching from said lid removable spaced portions of said skirt including first portions of said annular projection positioned between the lid-retaining portions of said skirt and leaving second annular projection portions of the annular projection in use;

said lid-retaining portions being deflectable outwardly away from said container to a release position in which portions of the annular projection thereon are moved outwardly relative to the container bead to allow easy removal of the lid from the container;

the tear line having upper tear line portions located above the removable spaced portions of the skirt and having lower tear line portions located below the lid retaining portions of the skirt;

angled tear line portions of the tear line extending at an angle to and between the upper tear line portions and the lower tear line portions;

a hinge line of reduced cross-sectional thickness in the skirt positioned above the lid-retaining portions of the skirt to facilitate upward pivoting of the lid-retaining portions; and barrier portions of increased cross-sectional thickness between said hinge lines and the upper tear line portions and at the angled tear line portions to act as barriers to tearing of the skirt from the upper tear line portions into the hinge lines instead of tearing into and along the angled tear line portions.

2. An easy-open, resilient plastic lid in accordance with claim 1 wherein said lid-retaining portions of said skirt are each formed with a thin hinge section positioned above the second annular projection portions to allow pivoting of the lid-retaining portions upwardly to the release position and downwardly into a retaining position to again engage the container bead to retain the lid on the container.

3. A resilient plastic lid in accordance with claim 2 wherein the annular projections on the lid-retaining portions of said skirt form a substantially annular ring for face-to-face engagement with the bead on the container wherein the sealing position, said annular ring being positioned adjacent said hinge sections.

4. An easy-open, resilient plastic lid in accordance with claim 3 wherein said body portion is provided with a second depending skirt spaced radially inwardly from said peripheral skirt and positioned to engage the inner circumference of the container rim, said second skirt and said peripheral skirt forming a downwardly facing annular channel to receive the container rim.

5. An easy-open, resilient plastic lid in accordance with claim 4 wherein the lid is a five gallon lid formed of high density polyethylene having a melt index between 5 and 10, and a density of about 0.9.

6. An easy-open, resilient plastic lid in accordance with claim 2 wherein said tear line extends around the circumference of said peripheral skirt on a zig-zag line with the upper tear line portions of said tear line being above said annular projection and parallel to peripherally spaced portions below and parallel to said annular projection with the angled tear line portions interconnecting ends of the upper tear line portions above said annular projection to ends of the lower tear line portions below said annular projection, the zig-zag line being visible to a user on the exterior of the peripheral skirt, and barrier portions of increased cross-sectional thickness between the tear line and the hinge sections.

7. The plastic lid of claim 1 in which the substantially annular projection on the skirt comprises spaced areas of reduced cross-sectional thickness located on the inside of the skirt, the angled tear line sections being in the form of V-shaped grooves on the outside of the skirt, the angled tear line portions of the tear line sections each extending across the spaced areas of reduced cross-sectional thickness of the substantially annular projection to facilitate tearing of the tear strip from the skirt.

8. The plastic lid of claim 1 and a plastic container in combination therewith, the container comprising:

a container body with an encircling sidewall, an upper rim on the container body sidewall, and a locking bead on the container rim for locking engagement with the substantially annular projection on the skirt of the plastic lid.

9. In combination; a reclosable resilient plastic lid and a container having a sidewall terminating at an upper edge and having an outwardly extending annular shoulder adjacent said edge, the combination comprising:

a circular body portion having an outer depending peripheral flange and an inner flange spaced radially inwardly of said outer flange and forming a downwardly facing channel which receives the upper edge of said container sidewall;

said outer flange being formed with an inwardly directed projection means which locks under said annular shoulder on said container to retain said lid in engagement with said upper edge of said container sidewall;

said outer flange being formed with a plurality of lid-retaining segments spaced apart by a plurality of peripherally spaced removable segments, said lid-retaining segments and said removable segments being connected by weakened tear line sections of said outer flange whereby said removable segments may be manually separated from said outer flange to permit removal of said lid from said container;

said lid-retaining segments being hingedly connected to said outer flange along a hinge line above said projection means to swing portions of said projection means on each lid-retaining segment outwardly with respect to said annular shoulder to permit easier removal of said lid from said container;

said lid being retained on an reclosing the container by placing said upper edge of said container in said channel and rotating said lid-retaining segments downwardly against said sidewall to engage the projection means thereon in gripping engagement with the annular shoulder of the container;

the tear line sections being on a radially exterior side of the outer peripheral flange and visible to indicate a tear strip for removal; said hinge line being defined by depressions in said radially exterior side of the outer peripheral flange;

the tear line sections having upper tear line portions located above the spaced removable segments of the outer flange and having lower tear line portions located below the lid-retaining segments of the outer flange;

said inwardly directed projection means on the outer flange having spaced areas of reduced cross-sectional thickness on an interior side of the outer flange;

angled tear line portions of the tear line sections on the exterior side of the outer flange connecting the upper and lower tear line portions and aligned with and extending across the spaced areas of reduced cross-sectional thickness of the projection means on the inside of the outer peripheral flange, first of said angled tear line portions extending down across the areas of reduced cross-sectional thickness to facilitate tearing thereacross in a downwardly direction and others of said tear line portions extending upwardly across areas of said reduced cross-sectional thickness to facilitate tearing thereacross in an upward direction.

10. The combination in accordance with claim 9 wherein said removable segments of said outer flange include portions of said projection means whereby separation of said removable segments and pivoting of said reclosable segments to the release position allows for easier removal of said lid from said container.

11. The combination in accordance with claim 9 wherein said tear strip is formed with a manual pull tab at one end positioned between adjacent hinged lid-retaining segments, said tab having an easily frangible connection at one end to permit separating one end of said tab from said outer flange whereby a manual force may be applied outwardly on said tear strip to separate it from said lid.

12. The combination in accordance with claim 9 wherein said hingeable connection for each lid-retaining segment comprises an elongated thin curved segment of said outer flange.

13. The combination in accordance with claim 9 wherein said annular shoulder on said container lies in a place substantially normal to the axis of said container, said projection means comprising a plurality of spaced portions defining a substantially annular projection, each of the projection portions having a flat upwardly facing surface which engages the surface of said shoulder.

* * * * *

UNITED STATES PATENT AND TRADEMARK OFFICE

CERTIFICATE OF CORRECTION

PATENT NO. : 5,238,135

DATED : August 24, 1993

INVENTOR(S) : Landis

It is certified that error appears in the above-identified patent and that said Letters Patent is hereby corrected as shown below:

ON THE TITLE PAGE: ITEM [73],

Change "Chicago" to --Chicago Ridge--.

Column 1, line 20, change "distributed" to --disturbed--.

Column 6, line 68, change "pain" to --paint--.

Column 7, line 7, change "was" to --way--.

Column 7, line 54, change "remain" to --remaining--.

Column 9, line 41, change "wherein" to --when in--.

Column 10, line 47, change "an" to --and--.

Column 12, line 13, change "place" to --plane--.

UNITED STATES PATENT AND TRADEMARK OFFICE

CERTIFICATE OF CORRECTION

PATENT NO. : 5,238,135

DATED : August 24, 1993

INVENTOR(S) : Landis

It is certified that error appears in the above-indentified patent and that said Letters Patent is hereby corrected as shown below:

Column 12, line 13, change "place" to --plane--.

Signed and Sealed this

Fifth Day of April, 1994

Bruce Lehman

*Attest:*

BRUCE LEHMAN

*Attesting Officer*

*Commissioner of Patents and Trademarks*